US005407451A

United States Patent [19]

Horodysky et al.

[11] Patent Number: 5,407,451

[45] Date of Patent: Apr. 18, 1995

[54] BORATED HYDROXYALKYL SULFIDES AND LUBRICANTS CONTAINING SAME

[75] Inventors: Andrew G. Horodysky, Cherry Hill; Joan M. Kaminski, Mullica Hill, both of N.J.

[73] Assignee: Mobil Oil Corporation, Fairfax, Va.

[21] Appl. No.: 397,750

[22] Filed: Jul. 13, 1982

[51] Int. Cl.[6] ..... C10L 1/24; C10L 1/30

[52] U.S. Cl. ..... 44/319; 44/435

[58] Field of Search ..... 44/53, 76, 435, 318, 44/319; 260/462 R; 252/48.4

[56] References Cited

U.S. PATENT DOCUMENTS

| | | | |
|---|---|---|---|
| 2,741,548 | 4/1956 | Darling et al. | 44/76 |
| 2,795,548 | 6/1957 | Thomas et al. | 252/49.6 |
| 3,009,798 | 11/1961 | Irish | 44/76 |
| 3,316,287 | 4/1967 | Nunn, Jr. et al. | 260/462 |
| 3,423,359 | 1/1969 | Young | 260/462 R |
| 3,558,686 | 1/1971 | Young | 260/462 R |
| 3,625,899 | 12/1971 | Sawyer et al. | 252/75 |
| 3,697,575 | 10/1972 | Naarmann | 260/462 R |
| 4,370,248 | 1/1983 | Horodysky et al. | 252/49.6 |
| 4,374,032 | 2/1983 | Gemmill et al. | 252/49.6 |
| 4,394,277 | 7/1983 | Small, Jr. | 252/48.4 |

OTHER PUBLICATIONS

SAE Technical Paper Series, 800436 The Performance of Fuel-Saving Engine Oils. J. R. Lohuis, J. A. Murphy and T. W. Rogers; Feb. 1980.

*Primary Examiner*—Jacqueline V. Howard

*Attorney, Agent, or Firm*—Alexander J. McKillop; Dennis P. Santini; Laurence P. Hobbes

[57] ABSTRACT

Lubricant and liquid fuel compositions contain a novel and unobvious friction reducing or antioxidant additive. The additive is a borated hydroxy/hydrocarbyl sulfide containing 2 hydroxy groups.

3 Claims, No Drawings

BORATED HYDROXYALKYL SULFIDES AND LUBRICANTS CONTAINING SAME

BACKGROUND OF THE INVENTION

1. Field of the Invention

The invention relates to lubricant and liquid fuel compositions. In particular, it relates to borated hydroxyalkyl sulfides and to their use in liquid fuels and in lubricants to reduce friction and fuel consumption in internal combustion engines.

2. Discussion of the Related Art

It is known that sliding or rubbing metal or other solid surfaces are subject to wear under conditions of extreme pressure. Wearing is particularly acute in modern engines in which high temperatures and contact pressures are prevalent. Under such conditions, severe erosion of metal surfaces can take place even with present generation lubricants unless a load carrying or antiwear additive is present herein.

Friction is also a problem any time two surfaces are in sliding or rubbing contact. It is of special significance in an internal combustion engine and related power train components, because loss of a substantial amount of the theoretical mileage possible from a gallon of fuel is traceable directly to friction.

With respect to the novel compounds of this invention, no art is known that teaches or suggests them, or their use in lubricants or fuels. There are, however, patents that disclose certain sulfur-containing materials. They include, for example, U.S. Pat. No. 3,361,723 which discloses a thiol-containing polyether and a process for its preparation and U.S. Pat. No. 4,244,827 teaches mixtures of di- or trithiophosphate acid diesters produced from 1,2-diols or 1-mercapto-2-hydroxy compounds and $P_2S_5$.

SUMMARY OF THE INVENTION

In accordance with the invention there is provided a lubricant or liquid fuel composition comprising a major amount of a lubricant or fuel and a friction reducing or antioxidant amount of a product selected from:

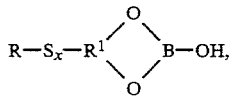

I

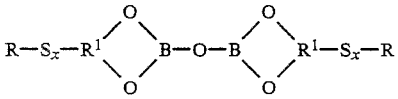

II and mixtures thereof wherein R, $R^1$ and x are as defined hereinafter. The product is made by reacting (1) a compound of the formula $$R\text{-}S_x\text{-}R^1(OH)_2 \qquad \text{III}$$

wherein R is a $C_6$ to $C_{25}$ hydrocarbyl group, preferably alkyl, $R^1$ is a $C_3$ to $C_6$ hydrocarbylene group and x is 1 or 2 with (2) boric acid, boric oxide, or an alkyl borate of the formula:

$$(R''O)_mB(OH)_n \qquad \text{IV}$$

wherein R'' is a $C_1$ to $C_6$ alkyl group, m is 1 to 3 and n is 0 to 2, the sum being 3. R can be alkyl, aryl, cycloalkyl, aralkyl or alkaryl, but is preferably alkyl. It will be understood that both the OH groups of formula III can be attached to any carbons in the $R^1$ group. It is not necessary, for example, that they be on adjacent carbon atoms, but it is preferable.

DESCRIPTION OF SPECIFIC EMBODIMENTS

The sulfides can be made by several processes known to the art. For example, they can be made by reacting a sodium alkylmercaptide with a diol, in accordance with the equation

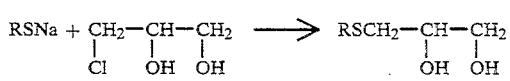

(1)

The same or similar compounds can be prepared from the reaction

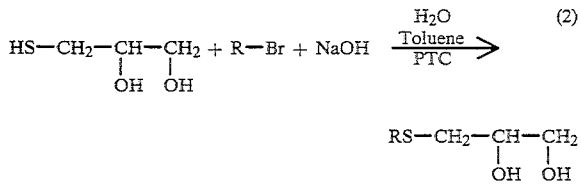

(2)

in which PTC is a phase transfer catalyst, e.g. $(C_8\text{–}C_{10})_3\text{-}N^+CH_3Cl^-$, used to enhance the solubility of the mercaptide formed in situ.

In reaction (1), specific mercaptans that can be used (to form the salt) include hexyl, octyl, nonyl, decyl, dodecyl, hexadecyl and octadecyl mercaptans and mixtures thereof. Equimolar amounts of the reactants are preferred, but an excess of either one can be used. Temperatures of reaction will range from room temperature to about 100° C. or more. The reaction can be completed at 2 to 3 hours or may take longer, depending upon reactants and reaction conditions.

Reaction (2) employs equimolar amounts of reagents, preferably, or an excess of one can be used. As in (1), the temperature can range from room temperature to about 100° C. or more. Times of reaction depend, in large measure, upon the degree of agitation and amount and effectiveness of the phase transfer catalyst. However, in this reaction, as well as in (1), the time of reaction is not critical and will be well within the skill of the worker in this art to determine.

In (1) and (2), the reactions have been illustrated using the $C_3$, or propylene $R^1$ group. $R^1$ also includes $C_4$ to $C_6$ groups, i.e., butylene, pentylene and hexylene groups.

Regarding the reaction of the boron compound with the hydroxy hydrocarbyl sulfides, it will generally be carried out at a temperature of from about 75° C. to about 150° C., preferably from about 75° C. to about 120° C. Equimolar amounts of reagents are preferred, but an excess of either reactant can be used. Here again, times will vary. They are not critical and can easily be determined.

In all reactions described hereinabove, a solvent is preferred. Solvents that can be used include the hydrocarbon solvents, such as toluene, benzene, xylene, and the like, alcohol solvents such as propanol, butanol, pentanol and the like, as well as mixtures of hydrocarbon solvents or alcohol solvents and mixtures of hydrocarbon and alcohol solvents.

The borated hydroxy hydrocarbyl sulfides are used with lubricating oils to the extent of from about 0.1% to about 10% by weight of the total composition. Furthermore, other additives, such as dispersants, detergents, viscosity index improvers, pour point depresseants, anti-oxidants, anti-wear agents and the like may be present. These can include phenates, sulfonates, succinimides, zinc dithiophosphates, polymers, calcium and magnesium salts and the like.

The lubricants contemplated for use with the compositions herein disclosed include mineral and synthetic hydrocarbon oils of lubricating viscosity, mixtures of mineral oils and synthetic oils and greases from any of these, including mixtures. The synthetic hydrocarbon oils include long-chain alkanes such as cetanes and olefin polymers such as oligomers of hexane, octene, decene, and dodecene, etc. The compounds of the invention-are especially effective in synthetic oils formulated using mixtures of synthetic hydrocarbon olefin oligomers and lesser amounts of hydrocarbyl carboxylate ester fluids. The other synthetic oils, which can be used alone with the borated compounds of this invention, or which can be mixed with a mineral or synthetic hydrocarbon oil, include (1) fully esterified ester oils, with no free hydroxyls, such as pentaerythritol esters of monocarboxylic acids having 2 to 20 carbon atoms trimethylolpropane esters of monocarboxylic acids having 2 to 20 carbon atoms, (2) polyacetals and (3) siloxane fluids. Especially useful among the synthetic esters are those made from polycarboxylic acids and monohydric alcohols. More preferred are the ester fluids made by fully esterifying pentaerythritol, or mixtures thereof with di- and tripentaerythritol, with an aliphatic monocarboxylic acid containing from 1 to 20 carbon atoms, or mixtures of such acids.

A wide variety of thickening agents can be used in the greases of this invention. Included among the thickening agents are alkali and alkaline earth metal soaps of fatty acids and fatty materials having from about 12 to about 30 carbon atoms per molecule. The metals are typified by sodium, lithium, calcium and barium. Fatty materials are illustrated by stearic acid, hydroxystearic acid, stearin, cottonseed oil acids, oleic acid, palmitic acid, myristic acid and hydrogenated fish oils.

Other thickening agents include salt and salt-soap complexes as calcium stearate-acetate (U.S. Pat. No. 2,197,263), barium stearate acetate (U.S. Pat. No. 2,564,561), calcium stearate-caprylate-acetate complexes (U.S. Pat. No. 2,999,065), calcium caprylate-acetate (U.S. Pat. No. 2,999,066), and calcium salts and soaps of low-, intermediate- and high-molecular weight acids and of nut oil acids.

Another group of thickening agents comprises substituted ureas, phthalocyanines, indanthrene, pigments such as perylimides, pyromellitdiimides, and ammeline.

The preferred thickening gelling agents employed in the grease compositions are essentially hydrophobic clays. Such thickening agents can be prepared from clays which are initially hydrophilic in character, but which have been converted into a hydro- phobic condition by the introduction of long chain hydrocarbon radicals into the surface of the clay particles; prior to their use as a component of a grease composition, as, for example, by being subjected to a preliminary treatment with an organic cationic surface active agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, is believed to require no further discussion, and does not form a part of the present invention. More specifically, the clays which are useful as starting materials in forming the thickening agents to be employed in the grease compositions, can comprise the naturally occurring chemically unmodified clays. The thickening agent is employed in an amount from about 0.5 to about 30, and preferably from 3 percent to 15, percent by weight of the total grease composition.

The liquid fuels contemplated include liquid hydrocarbon fuels such as fuel oils, diesel oils and gasolines and alcohol fuels such as methanol and ethanol or mixtures of these fuels. Concentrations used can range from about 1 lb/1,000 bbl of fuel to about 300 lbs/1,000 bbl of fuel, but preferably from about 2 lbs to about 35 lbs/1,000 bbl of fuel.

Having described the invention in general terms, the following are offered to specifically illustrate the development. It is to be understood they are illustrations only and that the invention shall not be limited except as limited by the appended claims.

EXAMPLE 1

Synthesis of 1,2-dihydroxy propane octadecyl sulfide

A mixture of 90% 1-mercaptoglycerol (56.7 g), 1-bromooctadecane (156.5 g), 50% sodium hydroxide (37.6 g), methyl tri ($C_8$–$C_{10}$) alkyl ammonium chloride (11.2 g), 40 cc toluene, and 20 cc of water was stirred vigorously. After an initial exotherm of 74° C. the reaction temperature slowly decreased and the reaction was continued at ambient temperature for 2 hours. Approximately 300 cc of toluene and 100 cc of water were added, and the reaction was heated to reflux. The hot reaction mixture was transferred to a separatory funnel, and the water layer was removed. The toluene solution was washed with water (2 times 100 cc) and dried over magnesium sulfate. The acidified water washes contained no 1-mercaptoglycerol.

The toluene solution was filtered through diatomaceous earth. Solvent was removed by high speed rotary evaporation under reduced pressure yielding a white, solid product.

EXAMPLE 2

Synthesis of 1,2-dihydroxypropane octadecyl sulfide borate

A solution of 1,2-dihydroxypropane octadecyl sulfide (80 g ), prepared as described in Example 1, n-butanol ( 43 g), and toluene (76 g) was heated to 60° C. and 9.3 g of boric acid were added. The expected amount of water was removed by azeotropic distillation with a maximum reaction temperature of 110° C. The reaction solution was filtered through diatomaceous earth. Solvent was removed by high speed rotary evaporation under reduced pressure yielding a waxy, white solid product.

EXAMPLE 3

Synthesis of 1,2-dihydroxypropane dodecyl sulfide

Approximately 97 g of 50% aqueous sodium hydroxide solution was added dropwise over a period of 7 hours to a solution of n-dodecyl mercaptan (1000 g) and 1-chloropropane-2,3-diol (547 g) in isopropanol solvent (2000 cc) at ambient temperature. The reaction temperature rose from 21° to 56° C. during the addition. The reaction was refluxed for 5 hours at 80° C. and then filtered hot through paper to remove the precipitated salt. The isopropanol solvent was removed by distillation. The product residue was dissolved in about 4000 cc of toluene and washed with water several times. The toluene solution was dried over magnesium sulfate and filtered through diatomaceous earth. Toluene was removed by high speed rotary evaporation under reduced pressure to yield a white solid product.

EXAMPLE 4

Synthesis of 1,2-dihydroxypropane dodecyl sulfide borate

A solution of 1,2-dihydroxypropane dodecyl sulfide (60 g), prepared as described in Example 3, n-butanol (40 g), and toluene (40 g) was heated to 55° C. and 9 g of boric acid were added. The expected amount of water was removed by azeotropic distillation with a maximum reaction temperature of 110° C. The reaction solution was filtered through diatomaceous earth. Solvent was removed by high speed rotary evaporation under reduced pressure yielding a white, waxy solid product.

EXAMPLE 5

Synthesis of 1,2-dihydroxypropane octyl sulfide

Approximately 40 g of 50% aqueous sodium hydroxide solution was added dropwise over a period of 1 hour to a solution of n-octyl mercaptan (72.3 g) and 1-chloropropane-2,3-diol (55 g) in isopropanol solvent (400 cc) at ambient temperature. The reaction temperature rose from 23° to 55° C. during addition. The reaction was refluxed for 3 hours at 80° C. and then filtered hot through paper to remove the precipitated salts. The isopropanol solvent was removed by distillation. The product residue was dissolved in 700 cc of toluene and washed with water several times. The toluene solution was dried over magnesium sulfate and filtered through diatomaceous earth. Toluene was removed by high speed rotary evaporation under reduced pressure to yield a colorless, opaque fluid.

EXAMPLE 6

Synthesis of 1,2-dihydroxypropane octyl sulfide borate

A solution of 1,2-dihydroxypropane octyl sulfide (70 g), prepared as described in Example 5, n-butanol (60 g), and toluene (60 g) was heated to 60° C., and 13.1 g of boric acid were added. The expected amount of water was removed by azeotropic distillation with a maxima reaction temperature of 115° C. The reaction solution was filtered through diatomaceous earth. Solvent was removed by high speed rotary evaporation under reduced pressure yielding a pale yellow fluid product.

The products of the Examples were blended into a fully formulated 5W-30 synthetic automotive engine oil containing other additives, such as detergent, dispersant, anti-oxidant and the like additives and evaluated using the Low Velocity Friction Apparatus (LVFA) test.

EVALUATION OF PRODUCTS

The compounds were evaluated as friction modifiers in accordance with the following test.

Low Velocity Friction Apparatus

Description

The Low Velocity Friction Apparatus (LVFA) is used to measure the friction of test lubricants under various loads, temperatures, and sliding speeds. The LVFA consists of a flat SAE 1020 steel surface (diameter 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which-is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cam motor arrangement.

Procedure

The rubbing surfaces and 12–13 ml of test lubricant are placed on the LVFA. A 240 psi load is applied, and the sliding speed is maintained at 40 fpm at ambient temperature for a few minutes. A plot of coefficients of friction ($U_k$) over the range of sliding speeds, 5 to 40 fpm (25–195 rpm), is obtained. A minimum of three measurements is obtained for each test lubricant. Then, the test lubricant and specimens are heated to 250° F., another set of measurements is obtained, and the system is run for 50 minutes at 250° F., 240 psi and 40 fpm sliding speed. Afterward, measurements of $U_k$ vs. speed are taken at 240, 300, 400, and 500 psi. Freshly polished steel specimens are used for each run. The surface of the steel is parallel ground to 4–8 microinches.

The data obtained are shown in Table 1. The data in Table 1 are reported as percent reduction in coefficient of friction at two speeds. The fully formulated 5W-30 synthetic lubricating oil containing detergent/dispersant/inhibitor package had the following general characteristics:

Viscosity 100° C. - 11.0 cs
Viscosity 40° C. - 58.2 cs
Viscosity Index - 172

TABLE 1

| Friction Characteristics Using Low Velocity Friction Apparatus | | | |
|---|---|---|---|
| | Additive Conc. | Reduction or % Change in Coefficient of Friction | |
| Additive | Wt. % | 5 Ft./Min. | 30 Ft./Min. |
| Base Oil | 0 | 0 | 0 |
| Example 2 | ½ | 46 | 37 |
| | ¼ | 27 | 35 |
| Example 4 | 2 | 50 | 38 |
| | 1 | 44 | 34 |
| | ½ | 40 | 29 |
| Example 6 | 1 | 32 | 20 |

Examples 4 and 6 were tested for corrosivity to copper. The copper corrosivity in accordance with ASTM D130-80. Table 2 shows the results. The compositions were clearly non-corrosive to copper using both test conditions.

TABLE 2

| Additive | Copper Corrosivity Characteristics Conc. in 200" SPN | 250° F., 3 Hrs. | 210° F., 6 Hrs. |
|---|---|---|---|
| Example 4 | 3 | 1A | 1A |
| | 1 | 1A | 1A |
| Example 6 | 3 | 1A | 1A |
| | 1 | 1A | 1A |

Representative samples of the above prepared compositions were also evaluated for antioxidant properties with a catalytic oxidation test in 200" solvent paraoffinic neutral mineral oil, A sample of the base lubricant was placed in an oven at 325° F. Present in the sample were the following metals either known to catalyze organic oxidation or commonly used materials of construction:

a. 15.6 sq. in. of sand-blasted iron wire b. 0.78 sq. in. of polished copper wire c. 0.87 sq. in. of polished aluminum wire d. 0.167 sq. in. of polished lead surface Dry air was passed through the sample at a rate of about 5 liters per hour for 40 hours. Table 3 shows the data.

TABLE 3

| Additive | Catalytic Oxidation Test 40 Hours @ 325° F. Additive Conc., Wt. % | Lead Loss mg | % Incr. in Visc. of Oxidized Oil using KV @ 100° C. | Neut. Number |
|---|---|---|---|---|
| Base oil | 0 | −1.2 | 67 | 3.62 |
| Example 4 | 3 | 0.5 | 6 | 0.73 |
| | 1 | 0 | 9 | 0.74 |
| Example 6 | 3 | 0 | 7 | 1.74 |
| | 1 | 0.02 | 8 | 1.18 |

We claim:

1. A liquid hydrocarbon or alcohol fuel composition comprising a major proportion of fuel and a friction reducing amount of a compound selected from:

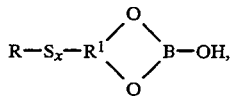

I

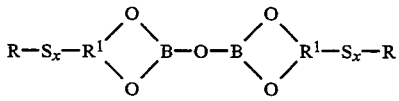

II and mixtures thereof wherein R is a hydrocarbyl group containing 6 to 25 carbon atoms, $R^1$ is a hydrocarbylene group containing 3 to 6 carbon atoms and x is 1 or 2.

2. The composition of claim 1 wherein the hydrocarbon is a fuel oil, diesel oil or gasoline.

3. The composition of claim 1 wherein the alcohol is methanol, ethanol or mixtures thereof.

* * * * *